United States Patent [19]

Bottoms

[11] Patent Number: 4,649,778

[45] Date of Patent: Mar. 17, 1987

[54] PIPE SPINNER ASSEMBLY

[76] Inventor: Clifford C. Bottoms, Rte. 2, Box 184L, McKinney, Tex. 75069

[21] Appl. No.: 308,389

[22] Filed: Oct. 5, 1981

Related U.S. Application Data

[63] Continuation of Ser. No. 94,784, Nov. 16, 1979, Pat. No. 4,306,471.

[51] Int. Cl.[4] ..... B25B 13/50

[52] U.S. Cl. ..... 81/57.33; 81/57.18

[58] Field of Search ..... 81/57.15–57.21, 81/57.33, 57.34, 57.35, 57.2, 57.39, 57.46

[56] References Cited

U.S. PATENT DOCUMENTS

| | | | |
|---|---|---|---|
| 1,031,261 | 7/1912 | Helm | 81/57.15 |
| 1,200,612 | 10/1916 | Helm | 81/57.18 |
| 2,089,800 | 8/1937 | Jones | 81/57.33 |
| 2,144,967 | 1/1939 | Gallagher | 81/57.33 |
| 3,799,010 | 3/1974 | Guier | 81/57.17 |
| 4,306,471 | 12/1981 | Bottoms | 81/57.33 |

FOREIGN PATENT DOCUMENTS

| | | | |
|---|---|---|---|
| 425441 | 3/1935 | United Kingdom | 81/57.33 |

*Primary Examiner*—Frederick R. Schmidt
*Assistant Examiner*—Debra S. Meislin
*Attorney, Agent, or Firm*—Freilich, Hornbaker, Rosen & Fernandez

[57] ABSTRACT

Apparatus which can be utilized on a drilling rig to aid in rotating drill pipe sections to connect and disconnect them, which uses a cat's head chain device to rotate the pipes but which avoids the danger arising when workmen wrap the chain around a pipe. The apparatus includes a jaw assembly which can be installed around a pipe section, and which has teeth on its inner surface to engage the pipe and sprockets on its outside to engage the cat's head chain so the chain can turn the jaw assembly. A stationary frame surrounds the jaw assembly while permitting it to rotate therewithin, the frame also carrying a backup roller to keep the chain engaged with the sprockets of the jaw assembly.

5 Claims, 4 Drawing Figures

PIPE SPINNER ASSEMBLY

This is a continuation of application Ser. No. 094,784 filed Nov. 16, 1979, now U. S. Pat. No. 4,306,471.

BACKGROUND OF THE INVENTION

The connection and disconnection of pipe sections on an oil well drilling rig for drilling oil and deep water wells, test holes and the like is typically accomplished by the use of a cat's head chain device. The chain extends from a motor driven drum, and can be wrapped around a pipe section to engage it. When the chain-wrapping drum is engaged with the motor, the drum pulls the chain to turn the pipe section and screw or unscrew it from another pipe section, depending upon the direction in which the chain was wrapped around the pipe. While this technique enables rapid connection and disconnection of pipe using simple equipment, it is the source of many injuries to workmen. A workman may hold the several turns of chain against the pipe to assure good chain gripping of the pipe, and his fingers may become caught between the chain and pipe. The large forces applied to the chain then can result in serious injury, and in fact this is a common cause of injury in the oil drilling industry.

While it is possible to conceive of a variety of devices that could turn pipe sections in a safer manner, but which operated on a very different manner than a typical cat's head chain, such devices would not be readily acceptable by the industry because cat's head chain devices are already present on drilling rigs and are well accepted as a low cost and effective means for turning pipes. An apparatus which was based on the common cat's head chain device but which helped avoid injury to workmen caused by their handling of chains with their hands near the pipes, would be of considerable value in reducing injuries in the oil well drilling industry.

SUMMARY OF THE INVENTION

In accordance with one embodiment of the present invention, an apparatus is provided for turning a heavy pipe, using a chain or other flexible tension member which is pulled by a motor driven apparatus, to avoid the danger which arises when a workman has to wrap a chain around the pipe. The apparatus includes a jaw assembly having an inner surface which can grip the pipe, a gap region which can be opened so the jaw assembly can receive the pipe and then close around it, and an outer jaw assembly surface which can engage the chain or other flexible tension member. A substantially stationary frame supports the jaw assembly in rotation with the pipe. A backup member such as a roller is mounted on the frame to hold the tension member in engagement with the jaw assembly, to assure that movement of the tension member causes rotation of the jaw assembly and therefore of the pipe. Accordingly, a typical cat's head chain device or the like can be utilized to apply power that rotates the pipe, but without requiring the chain to be wrapped several times about the pipe.

The novel features of the invention are set forth with particularity in the appended claims. The invention will be best understood from the following description when read in conjunction with the accompanying drawings.

DESCRIPTION OF THE PREFERRED EMBODIMENT

Figure 1:
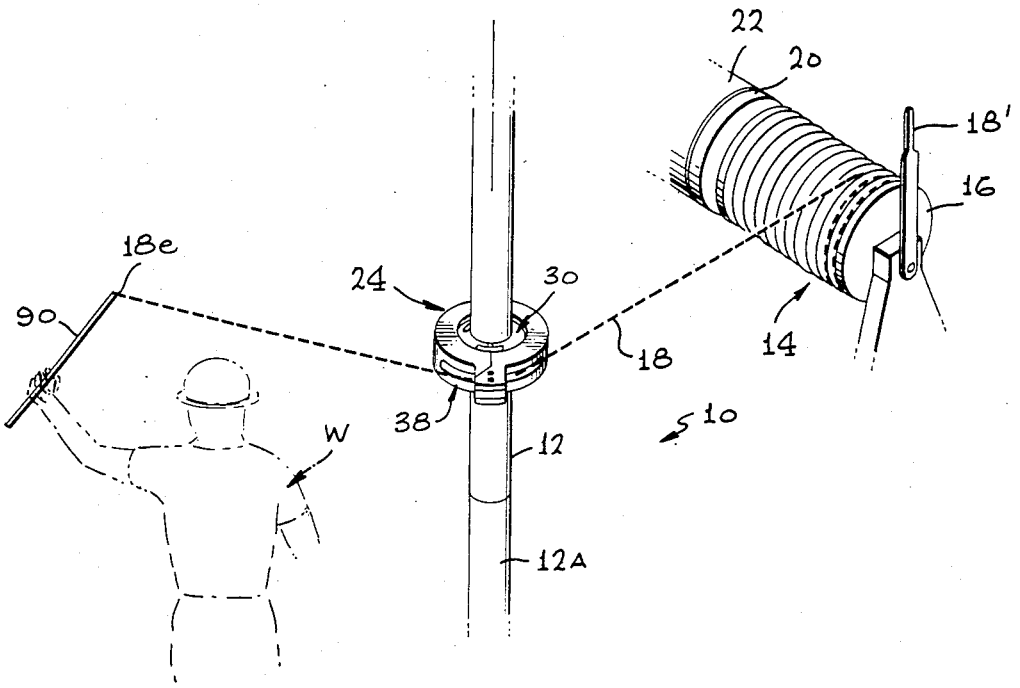
FIG. 1 is a partial perspective view of a pipe spinner installation constructed in accordance with the present invention.

FIG. 1 illustrates a portion of a drilling rig system 10 which includes a drill string having pipe sections such as 12, 12A which must be connected in series as the drill string is moved down into the earth and which must be disconnected when the drill string is lifted out of the earth. Rapid connection and disconnection of the pipe sections is facilitated by the use of a cat's head chain device 14 which includes a chain drum 16 which has a chain 18 or other flexible tension member wound thereon. A control handle 18' can be operated to engage and disengage a clutch 20 that can connect an engine or motor 22 to the drum 16 to turn it. In the prior art, a pipe section 12 was turned the required amount, of about four revolutions, to connect of disconnect it from another pipe section, by a workman wrapping the chain several times about the pipe section and holding it thereaginst with his hand, while another worker operated the lever 18 so the drum turned to wind up the chain. The direction of chain wrapping about the pipe section determined whether the pipe section was rotated to connect or disconnect it from the other section. It may be noted that tongs (not shown) also are provided to turn a pipe section by a fraction of a turn to fully tighten it or to initially loosen it.

The workman who wrapped the chain around the pipe and held the turns of chain against the pipe while it was rotated, could be seriously injured if his finger got caught between the chain and pipe. However, the simplicity of a cat's head chain device and its high reliability when exposed to mud, extremes of temperature, and other adverse conditions, has resulted in the widespread use of such devices and the presence of such devices on a large number of drilling rigs. It may be noted that this type of equipment also is used in drilling test holes to assess mineral deposits, and in other applications to connect casings or tubes, all of which may be referred to as pipes.

In accordance with the present invention, a pipe spinner apparatus 24 is provided, which enables the rapid turning of a pipe section 12 by several turns to connect or disconnect it from another section, using the power provided by a cat's head chain device 14 which is generally of the type commonly available on oil well drillings rigs, but which avoids high danger to a workman W. High risk of injury to the workman W is avoided by avoiding the need for wrapping the chain around the pipe section 12, and also by avoiding the need for a workman to hold the chain closely near the location where it is in engagement with the pipe section.

Figure 2:
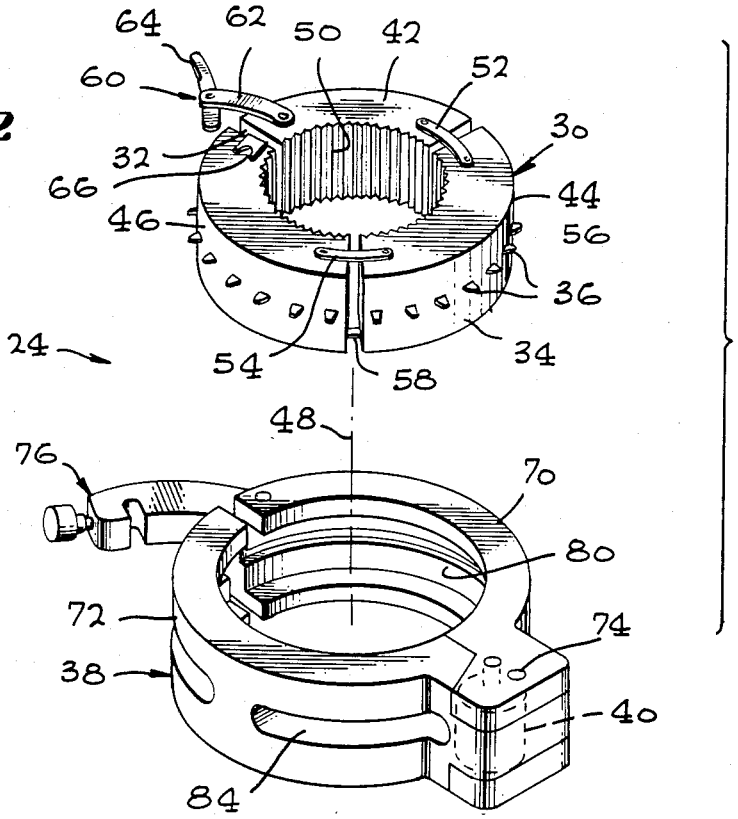
FIG. 2 is an exploded perspective view of the pipe spinner apparatus of FIG. 1.
Figure 3:
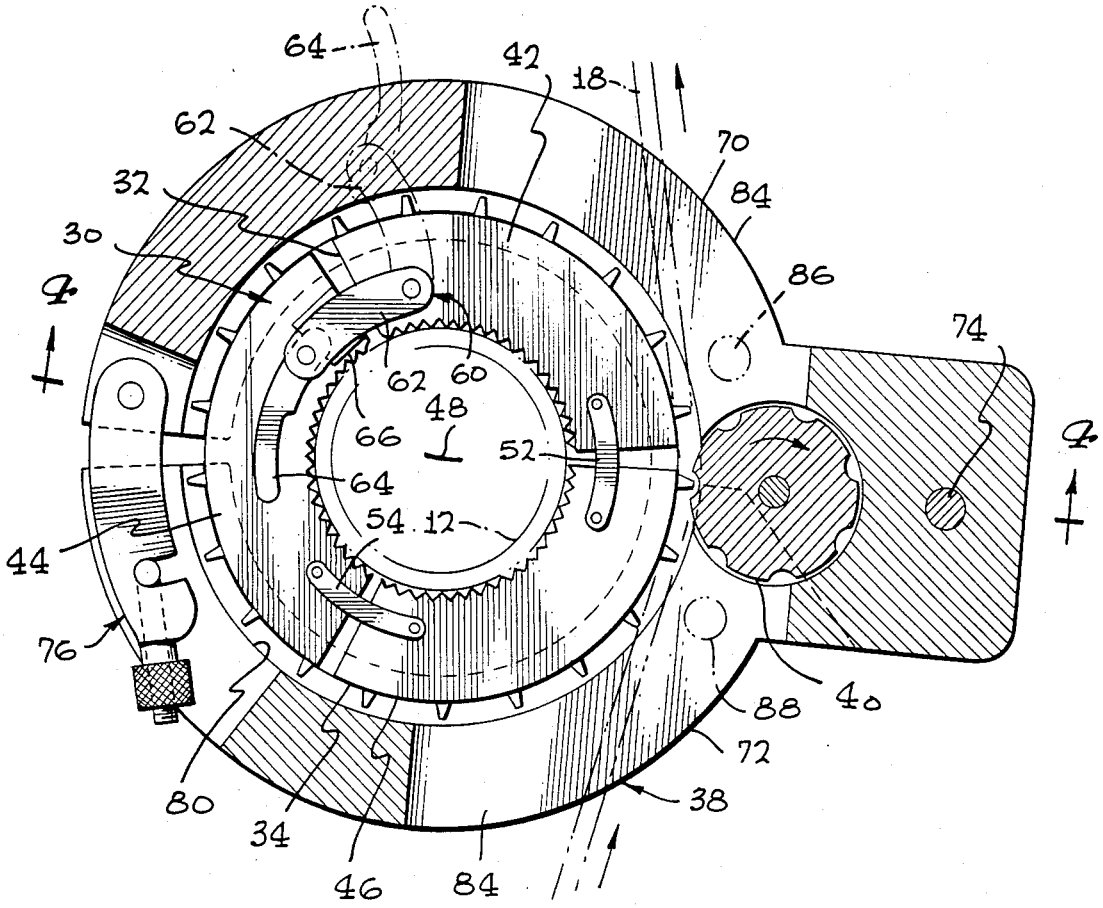
FIG. 3 is a partial plan view of the pipe spinner apparatus of FIG. 2.
Figure 4:
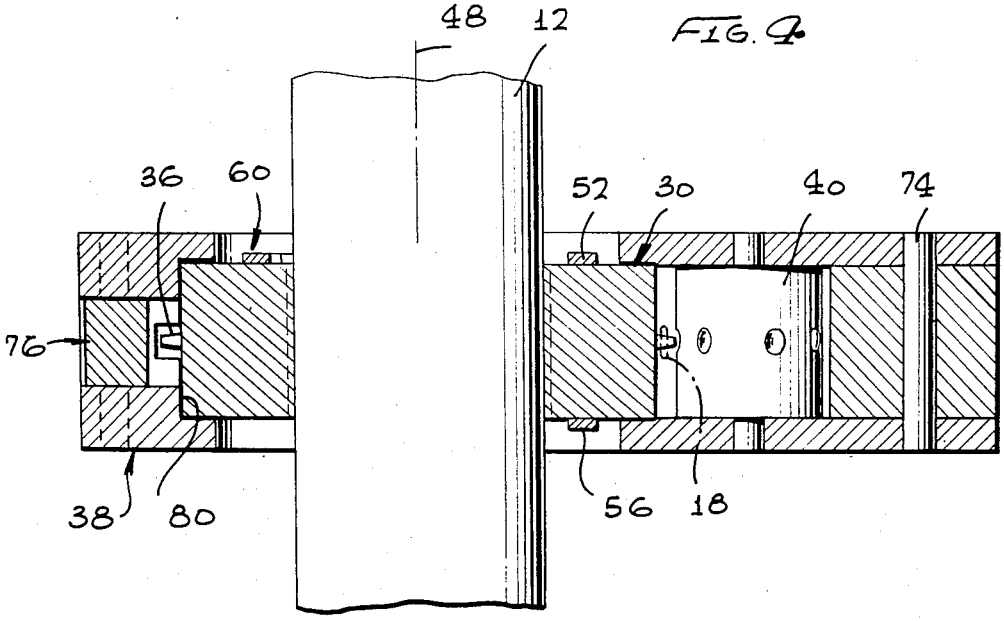
FIG. 4 is a sectional view taken on the line 4—4 of FIG. 3.

As shown in FIGS. 2–4, the pipe spinner assembly 24 includes a jaw assembly 30 which has a gap area 32 that can be opened to receive a pipe section, and which can be closed tightly around the pipe section to engage it. The jaw assembly has an outer surface 34 with sprocket teeth 36 which can engage the chain 18 or other tension member, so that movement of the chain can cause rotation of the jaw assembly 30 and of the pipe section engaged by the jaw assembly. In order to hold the chain or other tension member securely against the peripheral surface 34 of the jaw assembly, a frame 38 is provided which rotatably supports the jaw assembly 30 while the frame remains stationary, and which carries a backup member in the form of a roller 40 which can hold the chain or other tension member securely against the jaw assembly to rotate it.

The jaw assembly 30 includes three dies or jaws 42, 44, 46 which each extend about 120° about the axis 48 of the assembly. Each jaw such as 42 has an inner surface 50 formed with pipe wrench teeth to engage a drill pipe, and has an outer portion designed to rotate smoothly on the frame 38. A pair of link-like connectors 52, 54 connect the jaw 46 to each of the other two jaws 42, 44, each link being pivotally connected at each end to one of the jaws. An additional pair of links 56, 58 connect the jaws at their opposite sides. A lock mechanism 60 is provided to lock the two jaws 42, 44 together tightly around a pipe section. As shown in FIG. 3, the lock mechanism 60 includes an arm 62 pivotally mounted on the jaw 42, a camming member 64 pivotally mounted on the arm 62, and a striker 66 mounted on the jaw 44. The mechanism enables the jaw assembly to tightly grip the pipe section without relying upon tension in the chain 18 or wrapping of the chain around the pipe section to provide such engagement.

The frame 38 (FIG. 2) includes two sections 70, 72 that are pivotally connected at 74 to open around the jaw assembly and then close around it. A frame lock device 76 can lock the frame in a closed position around the jaw assembly. It may be noted that the frame 38 does not have to be cammed tightly around the jaw assembly, and in fact must not be tightly clamped around it, inasmuch as the jaw assembly must freely rotate within the frame. The frame has a raceway 30 which receives the closed jaw assembly 30 to permit the jaw assembly to freely rotate therewithin together with the rotating pipe section. As shown in FIG. 3, the backup roller 40 is positioned close to the peripheral surface 34 of the jaw assembly, so that a chain 18 which is engaged with the sprocket teeth 36 of the peripheral surface 34 are securely held in engagement therewith, without the need for extensive wrapping of the chain around the jaw assembly.

The backup roller 40 can be formed with recesses peripheraly spaced by the same amount as the sprocket teeth 36 are spaced about the jaw assembly, to receive the sprocket teeth so that the chain links cannot slip past them. It is desirable to provide some wrapping of the chain 18 about the jaw assembly 30, such as perhaps one-fourth of a full turn, so that the tendency of the chain to slip out of the sprocket teeth 36 is minimized. However, the apparatus can operate with any degree of wrapping. The force which the tension member must apply to the jaw assembly, is less than a chain must apply to the pipe, because of the longer outer diameter of the jaw assembly. For example, for a common 4½ inch pipe with a 6-inch diameter pen portion, the use of a jaw assembly of 12-inch outer diameter enables the same torque to be applied to the pipe using one-half the force. Thus, it is even possible to use a rope or cable to turn the jaw assembly, with less than a full 360° wrap, especially where the backup roller presses the tension member tightly against the jaw assembly.

It may be noted that the frame is provided with openings 84 on either side of the backup roller 40 to pass the chain therethrough. Also, a pair of side roller members indicated at 86 and 88 can be provided to encourage at least some wrap of the chain while minimizing the possibility of jamming.

The pipe spinner assembly 24 can be installed on a pipe section 12 by unlocking the lock mechanism 60 to the position shown in phantom lines in FIG. 3, and opening the jaw assembly to widen the gap 32 so that the jaw assembly can be fitted around the pipe. The lock 60 is then closed to tightly clamp the jaw assembly around the pipe. It may be noted that an adjustment mechanism can be provided on the lock 60 to enable tight gripping of a pipe section of given diameter despite moderate wear on the pipe or on the jaw assembly. Also, it is possible to use springs to connect the jaws and draw them tightly around the pipe. After the jaw assembly has been clamped on the pipe, the frame 38 can be clamped around the jaw assembly by pivoting the frame sections 70, 72 apart and then together around the jaw assembly and closing the frame lock 76 on the frame. The chain 18 is normally maintained so it extends through the openings 84 in the frame, even when not in use, so that once the frame is closed the chain will lie against the peripheral surface 46 of the jaw assembly. The system then can be operated, as shown in FIG. 1, by providing some tension on the chain end **18*e*, which is opposite the wind up drum 16, to prevent entanglement, and by having a workman operate the control 18 to begin rotation of the windup drum. A handle 90 is fastened to the end 18*e* of the chain, to enable a workman to hold the handle 90 so as to further reduce the possibility of injury to the workman's hand. It is also possible to merely hang the handle 90** and some of the chain over a handrail or the like.

In the installation shown in FIG. 1, the pipe spinner assembly 24 is mounted so that the pipe section 12 is unscrewed from the other section 12A when the drum 16 rotates. When it is desired to rotate a pipe section in the opposite direction to connect it to the previous pipe section, this can be accomplished by installing the pipe spinner assembly 24 in an upside-down position from that shown. While the tension member 18 which is utilized to operate the pipe spinner assembly 24 can be the same kind of chain that can be used in direct wrapping around the pipe, a smoother and more reliable operation of the pipe spinner assembly 24 can be obtained by utilizing a more even tension device such as a chain belt. However, the rest of the cat's head chain device 14 can still be used.

Thus, the invention provides an apparatus for turning a heavy drill pipe, using a cat's head type of device which is commonly available on drilling rigs, but which helps to safeguard workmen from the dangers arising from the typical manner of use of a cat's head chain device. This is accomplished by utilizing a pipe spinner apparatus which has a jaw assembly that can grip a pipe without requiring multiple wrapping of a chain around the pipe or even around the jaw assembly, but which utilizes movement of the chain by a motor to turn the jaw assembly and therefore a pipe section engaged by it. The jaw assembly can be provided with a peripheral surface engageable with a chain or other tension member, and with the jaw assembly rotatably mounted on a frame that remains substantially stationary. A backup member such as the roller can be provided on the frame at a position to hold the tension member against the outer surface of the jaw assembly, to maintain engagement of the chain to rotate the jaw assembly without requiring a full circle of wrap of the chain thereabout.

Although particular embodiments of the invention have been described and illustrated herein, it is recognized that modifications and variations may readily occur to those skilled in the art and consequently, it is intended that the claims be interpreted to cover such modifications and equivalents.

I claim:

1. Apparatus for turning a heavy pipe, using a chain or other flexible tension member which is pulled by a motor driven apparatus, comprising:

a jaw assembly having an inner surface which can grip a pipe to turn it, said jaw assembly also having an outer surface which can engage the flexible tension member;

a frame supporting said jaw assembly in rotation thereon, a roller rotatably mounted on said frame and positioned to lie on a side of the tension member opposite the jaw assembly to hold the tension member squeezed between the jaw assembly and roller, said roller being spaced from said jaw assembly so the flexible tension member can pass between them, said frame having openings at either side of said roller to pass the tension member therethrough with less than a full turn of the tension member around the jaw assembly surface.

2. The apparatus described in claim 1 including:

a flexible tension member lying between said roller and said jaw assembly extending through said openings.

3. Apparatus for turning a heavy pipe, using a chain or other flexible tension member which is pulled by a motor driven apparatus, comprising:

a jaw assembly for wrapping around a pipe, said assembly having a rotation axis, jaws which each extend by less than a half-circle about said axis and which each have ends with pairs of ends lying adjacent to one another, a plurality of connectors which pivotally connect said jaws to allow them to spread apart to receive and then close around a pipe, and locking means for holding the adjacent ends of a pair of jaws close enough together to hold all jaw sections in tight engagement with the pipe; and a frame assembly which has a plurality of sections which are pivotally joined to open and then close around the jaw assembly when the jaw assembly lies around a pipe; said frame assembly having a raceway rotatably engaging said jaw assembly to permit the jaw assembly to rotate thereon.

4. The apparatus described in claim 3 wherein:

said frame assembly includes a backup roller rotatably mounted on one of said frame sections and positioned with its periphery adjacent to but spaced from a peripheral surface of said jaw assembly to hold a tension member against the jaw assembly, and openings on either side of the roller to pass the tension member.

5. The apparatus described in claim 3 including:

a flexible tension member partially wrapped about said jaws of said jaw assembly.

* * * * *